US007048522B2

(12) United States Patent
Bradford, Jr.

(10) Patent No.: US 7,048,522 B2
(45) Date of Patent: May 23, 2006

(54) FLUID BALANCED PUMP

(76) Inventor: Floyd John Bradford, Jr., 5642 Wickersham, Houston, TX (US) 77056

( * ) Notice: Subject to any disclaimer, the term of this patent is extended or adjusted under 35 U.S.C. 154(b) by 304 days.

(21) Appl. No.: 10/446,606

(22) Filed: May 28, 2003

(65) Prior Publication Data

US 2004/0241024 A1 Dec. 2, 2004

(51) Int. Cl.
*F04B 39/10* (2006.01)

(52) U.S. Cl. ..... 417/555.1; 417/555.2

(58) Field of Classification Search ..... 417/555.1, 417/555.2

See application file for complete search history.

(56) References Cited

U.S. PATENT DOCUMENTS 2,384,173 A * 9/1945 Johnston ..... 417/377

6,155,803 A * 12/2000 Curington et al. ..... 417/383

* cited by examiner

*Primary Examiner*—Charles G. Freay
(74) *Attorney, Agent, or Firm*—The Matthews Firm

(57) ABSTRACT

A rodless pump is disclosed which is connected to a pressure source via a first conduit. In a common oilfield application the pump would be connected to the bottom of a tubing string within the reservoir fluid to be produced. A pressure source such as a hydraulic pump would be connected at the surface to the tubing string so as to selectively apply pressure via fluid in the first conduit to the pump, raising the plunger assembly in the pump drawing reservoir fluid into the pump. When pressure via the surface pressure source is released, a balancing fluid, connected to the pump from the surface through a second conduit positioned within the first conduit, urging the plunger assembly downward in the pump urging the reservoir fluid in the pump into the tubing and to the surface. Preferably, the pump includes dampening mechanisms at both the top and bottom of the plunger stroke so as to reduce metal to metal impact within the pump. This dampening mechanism may include but is not limited to elastomer barriers, springs, and other dampening mechanisms such as discussed further within.

17 Claims, 6 Drawing Sheets

FLUID BALANCED PUMP

AREA OF TECHNOLOGY

The present device relates generally to subsurface pumps for removing fluids from subterranean reservoirs and in particular to a rodless pumping system.

BACKGROUND OF INVENTION

Presently, low pressure reservoirs, incapable of producing fluid from the reservoir to the surface naturally, account for over 90% of the hydrocarbon producing wells in the United States. There are various means of pumping fluid from these wells, such as the use of sucker rod pumps, hydraulic pumps, jet pumps, and semi-submersible electric pumps. Most of these low-pressure wells produce fluid at too low of a flow rate for the majority of the current art pumps to operate efficiently.

The most common system for producing these low pressure, low flow rate wells is through the use of sucker rod pumping systems. Sucker rod pumping systems include a downhole plunger and cylinder type pump connected to a surface unit by means of rods or sucker rods. This surface unit is commonly referred to as a pump jack. The present art sucker rod systems have several limitations and problems. One problem is that while the stroke length of the pump and the strokes per minute may be controlled through the selection of the pump jack size. Pumping jacks are expensive and each pump size is adapted for a specific range of flow rates and depth of the reservoir. Once the pump unit is placed it is cost prohibitive to change the pump jack. Another problem with these systems resides within the use of the sucker rods. Sucker rods are metal or fiberglass rods which are connected together to form one continuous string of rods often several thousand feet in length when used in hydrocarbon wells. These rod strings are connected usually by the use of pin and box connections. The process of connecting the rods string when running into the hole or disconnecting the strings when pulling out of the hole is time consuming and costly. Additionally, the length and weight of these rods and the reciprocation of the rods produced by the pump jack results in failure, commonly by parting, of the sucker rod string. Another problem is that the sucker rod string is positioned within a tubular string such as tubing. When the system is operating the rod string commonly contacts the tubular string at several points which results in wear of both the rod sting and the tubular string resulting in failure of the well. Some studies have shown that these rod pumping systems fail on the average of once every six months resulting in significant repair and maintenance costs, often making producing the well uneconomical. Failure rates in rod pumping systems greatly increase with the deviation of the well bore from vertical.

There have been attempts to develop a pumping system which utilizes the plunger/cylinder type downhole pump while eliminating the use of sucker rods and the related problems. These prior art rodless pump systems typically include a surface unit, which is connected to a subsurface pump by a fluid conduit such as the tubing string. The surface unit activates the subsurface pump by applying pressure to the fluid in the tubing string to compress a spring means in the subsurface pump and displace a slidable piston to draw fluid from the well into a pump chamber. When the surface unit releases the fluid pressure, a spring mechanism in the subsurface pump will displace the piston and lift the fluid into the pump chamber into the tubing string and to the surface. Such systems are disclosed in U.S. Pat. Nos. 2,058,455; 2,123,139; 2,126,880; and 2,308,609. Although, these prior art systems eliminate the rod string they utilize a compression spring for lifting the produced fluid into the tubing string. These springs severely limit the stroke length and thus the flow rate of the pump and also tend to fail due to wear and or the accumulation of trash carried into the pump.

Other prior art rodless pumps such as disclosed in U.S. Pat. No. 4,297,088 replaces the physical spring with a gas chamber. When pressure is applied to the tubing string, a piston will compress the gas within the chamber and, when the pressure is relieved, the gas will expand to lift fluid into the tubing string. These systems allow for a very long stroke length and thus much higher efficiency, but introduces additional problems. A major problem with these prior art pumps is that unlike sucker rod pumps the rodless pumps do not have a precisely defined stroke length. In these rodless pumps, the stroke length is affected by the length of time the surface unit applies pressure to the fluid in the tubing string on each cycle. It is also affected by the compressibility of the fluid in the tubing string and the amount of ballooning of the tubing that occurs. The stroke length is also influenced by the pressure in the gas chamber, since the pressure in the gas chamber must be sufficient to support the hydrostatic pressure of the entire column of fluid back to the surface at the end of the downstroke, the plunger has enough force being applied to it at the end of the downstroke to cause it to strike the limit stop in the barrel with a sever impact. Also since the surface unit will not stop pressuring the tubing at the precise moment to prevent contact, the plunger will impact the limit stop on this end of the stroke. Thus, unlike sucker rod pumps, these pumps are difficult to design in a manner such that the maximum stroke may be utilized without the plunger contacting the barrel at the end of the upstroke and downstroke. This contact severely limits the life of the pumps.

Another prior art rodless pump disclosed in U.S. Pat. No. 6,155,803, overcame the limitations regarding the severe plunger impacts, as discussed above, at the end of each stroke. However, that rodless pump system still utilized a downhole gas source within the pump to force that plunger assembly downward after the surface pressure source released the pressure being exerted on the downhole pump. The gas pressure source required a substantially self contained pressure chamber containing a substantially compressible fluid. This chamber was part of the pump and was positioned downhole. The chamber was also preferably precharged with a gas such as nitrogen. Although this arrangement was an improvement over prior art, particularly involving the plunger impact, it still proved to possess some inherent limitations. These limitations included a requirement of a very high precharge pressure in the gas chamber, a possible short life of the pistons, due to fluid leakage and contamination, and a requirement of bleeding the substantial gas chamber pressure whenever bringing the pump to the surface. The current device is an improvement of this prior art particularly with respect to eliminating the downhole gas source or gas pressure chamber within the pump.

It is thus a desire to have a rodless pump system which overcomes the limitations and problems of the prior art pumps. Thus, this pumping system utilizes a combination of two conduits, one conduit being connected to a pressure source and the second conduit containing a balance fluid extending to the surface thereby eliminating the need for the downhole gas chamber previously required to lift the hydrostatic fluid to the surface. This arrangement greatly reduces the surface pressures required to operate the system thus eliminating the pressure limitations encountered at relatively shallow depths by prior systems and eliminates the limitations imposed with the downhole gas source.

In a common oilfield application the pump would be connected to the bottom of a tubing string within the reservoir fluid to be produced. A pressure sources such as a hydraulic pump would be connected at the surface to the tubing string so as to selectively apply pressure by way of the fluid in the conduit to the pump, raising the plunger assembly in the pump drawing reservoir fluid into the pump. As the plunger assembly moves upward it raises the fluid contained in the second conduit an equal distance thereby creating an imbalance in hydrostatic pressures of the two fluid columns interfacing at the downhole pump. When pressure generated by the surface pressure source is released, the imbalance between the two conduits forces the plunger assembly downward in the pump pushing the reservoir fluid in the pump into the tubing string and upward toward the surface.

Preferably, the pump includes dampening mechanisms at both the top and bottom of the plunger's stroke so as to reduce metal to metal impact within the pump at the end of the top and bottom of the each stroke of the plunger assembly. The dampening mechanism may include but is not limited to an elastomer barrier, a spring, and dampeners such as discussed further below. Several different configurations may be used singularly or in combination to reduce the metal to metal impact and increase the life of the pump.

BRIEF DESCRIPTION OF THE DRAWINGS

For a further understanding of the nature and objects of the fluid balanced pump, reference should be had to the following detailed description, taken in conjunction with the accompanying drawings, in which like elements are given the same or analogous reference numbers and wherein.

DETAILED DESCRIPTION OF THE PREFERRED EMBODIMENT

Figure 1:
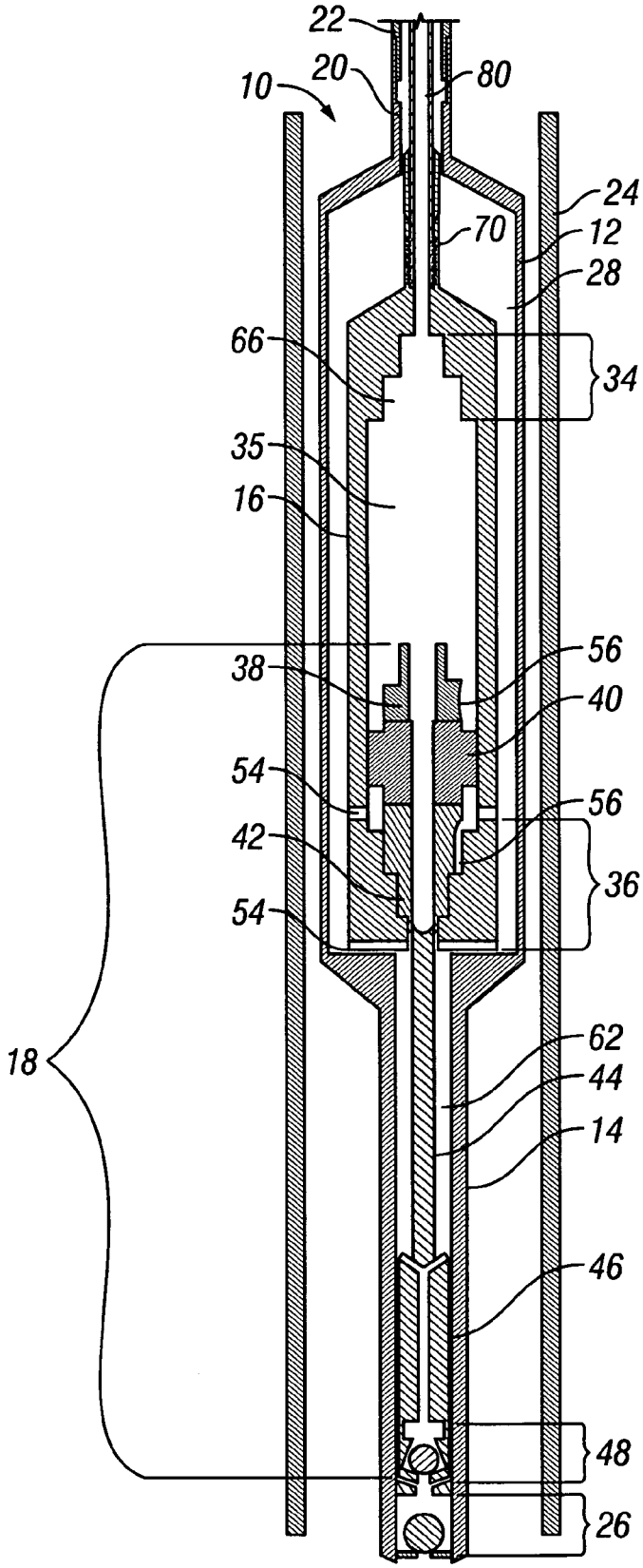
FIG. 1 is a cross-section view of the downhole pump of the fluid balanced pump system with the plunger assembly at the lowest most position of the pump stroke.

FIG. 1 is a cross-section view of the fluid balanced pump generally designated by the numeral 10. Pump 10 includes a housing 12 having a lower barrel 14 extending therefrom, an upper barrel 16, and a plunger assembly 18 movably disposed therein.

As shown in FIG. 1, housing 12 has a top end 20 adapted for connecting to a first conduit, the tubing string 22, which is connected to a surface pumping unit (not shown) such as a hydraulic pump having a timed cycle for controlling the upstroke and downstroke of plunger assembly 18. Upper barrel 16 has a top end 70 adapted for connecting to a second conduit 80. The second conduit 80 is positioned within tubing string 22 and is connected to a surface source for a balancing fluid, which is discussed in further detail below. Pump 10 is positioned at the bottom end of the tubing 22 within the well casing 24 below the reservoir fluid level.

Housing 12 is an elongated member extending to lower barrel 14. At the lower end of the lower barrel 14 is a standing valve 26 to allow reservoir fluid to flow into housing 12 and prevent fluid from within housing 12 flowing out and back into casing 24. Positioned within housing 12 is upper barrel 16. Within upper barrel 16 is formed cavity 35. The top end of cavity 35 forms an upper dampening chamber 34. The bottom end of cavity 35 forms a lower dampening chamber 36. Formed between housing 12, upper barrel 16, and the top of the lower barrel 14 is annulus 28 which is in fluid connection with tubing 22 for containing and producing reservoir fluid to the surface. At least one port 54 is formed through upper barrel 16 to allow fluid from annulus 28 into the interior of barrel 16 and vice versa.

Plunger assembly 18 includes an upper dampener 38, an upper plunger 40, a lower dampener 42, a rod 44, a lower plunger 46, and a traveling valve 48. Plunger assembly 18 may be of unitary construction or of various connected assemblies. Preferably, upper plunger 40 has a larger diameter than lower plunger 46.

Plunger assembly 18 is movably positioned within upper barrel 16 and cavity 35 and at the top of lower barrel 14. Positioned within upper barrel 16 are the upper dampener 38, the upper plunger 40, and the lower dampener 42. Positioned within lower barrel 14 are the lower plunger 46 and the traveling valve 48. The upper and lower sections of plunger assembly 18 are interconnected by rod 44. Formed between upper plunger 40 and lower plunger 46 is a cavity 62.

Both upper dampener 38 and lower dampener 42 may have at least one slot 56 formed along a portion of the length thereof to reduce contact between the plunger assembly 18 and barrels 14 and 16 for both the top of the upstroke and the bottom of the downstroke. The slot 56 may extend only along a portion of the dampener 38 and/or 42. Operation of slot(s) 56 for dampening impact is discussed in detail below.

A balancing fluid 66, such as salt water or other water produced from the reservoir formation, is contained within chamber 35 and the second conduit 80 and commonly above the upper plunger 40. Typically, the balancing fluid is not externally pressurized and relies on the column pressure based on the length of the second conduit 80. Preferably, the balancing fluid 66, in chamber 35 and the second conduit 80, is balanced against the pressure in the tubing string 22 as produced by the surface pump (not shown). Preferably, when pump 10 is in the bottom position, there is a substantial balance of the hydrostatic pressures in the tubing string 22 and the second conduit 80. On the upstroke the balancing fluid 66 is pushed out of chamber 35 and up into the second conduit 80. This action in turn creates an imbalance between the pressure in tubing string 22 and the pressure in the second conduit 80. Upper plunger 40 forms a barrier between tubing fluid and the balancing fluid 66. Because the seal between upper plunger 40 and upper barrel 16 in which it strokes may be merely a very close fit, some transfer of fluid may occur.

Operation of the pump system is described with reference to FIGS. 1 through 6. This process, as shown in FIGS. 1 through 6 and discussed below, is repeated until the well is pumped down. Downhole pump 10 is connected to the lower end of tubing 22 and run into casing 24 preferably below the reservoir fluid level. The top of tubing string 22 is connected to a surface pumping unit to apply and release pressure in the tubing string. Within tubing string 22, is positioned the second conduit 80 which allows communication of the balancing fluid with chamber 35.

FIG. 1 shows the plunger assembly 18 in its lowermost position with the well fluid and the balancing fluid static and only hydrostatic pressure is present at the position of pump 10. Standing valve 26 and traveling valve 48 are both closed. Lower dampener 42 is positioned within lower dampener chamber 36 in a substantially tight fit.

Figure 2:
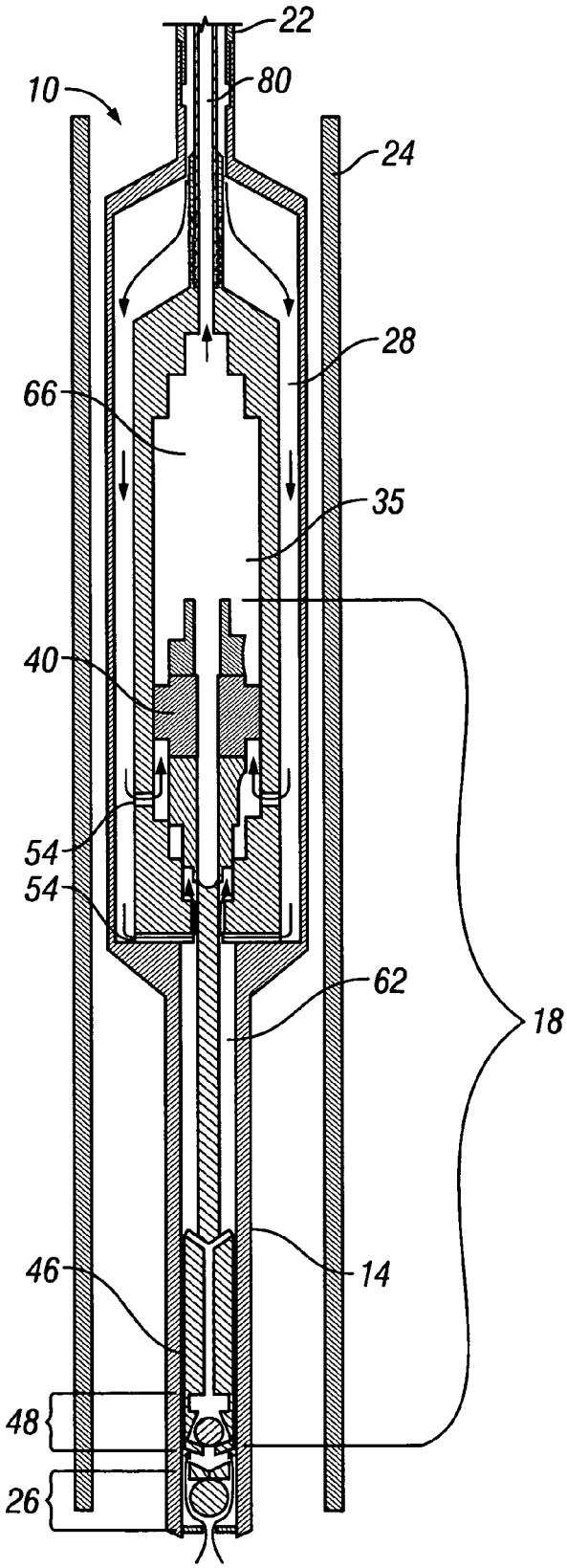
FIG. 2 is a cross-section view of the downhole pump of the fluid balanced pump system with the plunger assembly moving upward in response to the application of pressure from a surface pumping unit to the fluid in the tubing string.

FIG. 2 shows plunger assembly 18 of pump 10 beginning to move upward. As the surface unit is activated, fluid is pumped down tubing 22 (as shown by the arrows) into annulus 28 through ports 54 into cavity 62 between upper and lower plungers 40 and 46 moving plunger assembly 18 upward due to the larger diameter of plunger 40 as opposed to the diameter of plunger 46. At substantially the same time, the balancing fluid 66 is forced out of cavity 35 and upwards into the second conduit 80 (as shown by the arrows). Traveling valve 48 remains closed and standing valve 26 opens to allow fluid from casing 24 to enter and fill lower barrel 14.

Figure 3:
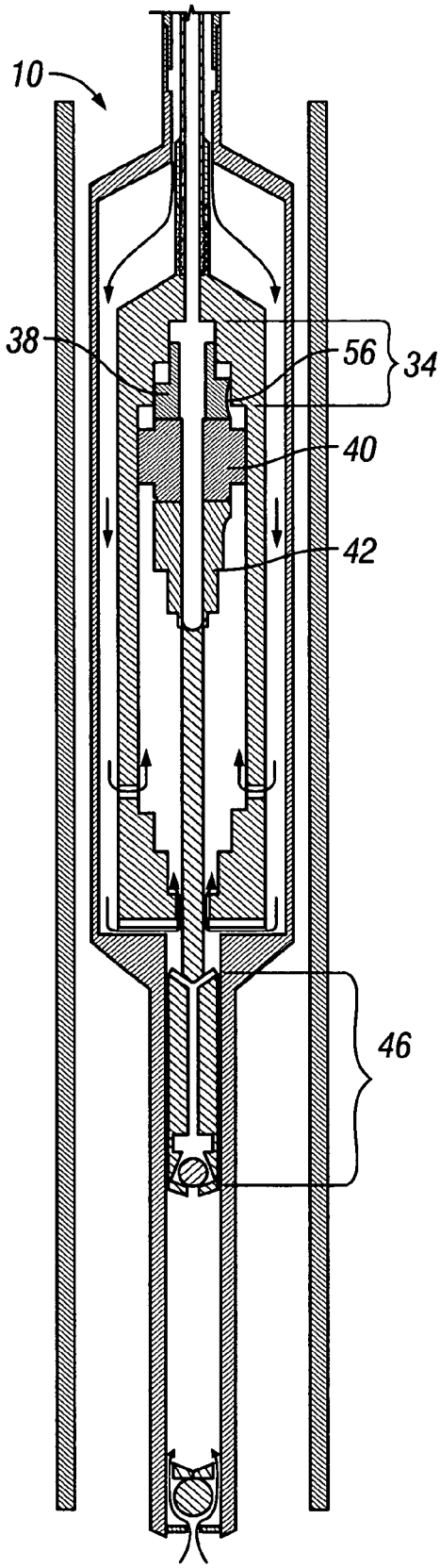
FIG. 3 is a cross-section view of the downhole pump of the fluid balanced pump system with the plunger assembly nearing the top of the upstroke.

FIG. 3 shows pump 10 with plunger assembly 18 nearing the top of the stroke. Upper dampener 38 is entering dampener chamber 34. Fluid is being metered out of chamber 34 through slot 56 in the dampener at a controlled rate to decelerate plunger assembly 18 before dampener 38 impacts upper barrel 16 forming chamber 34.

Figure 4:
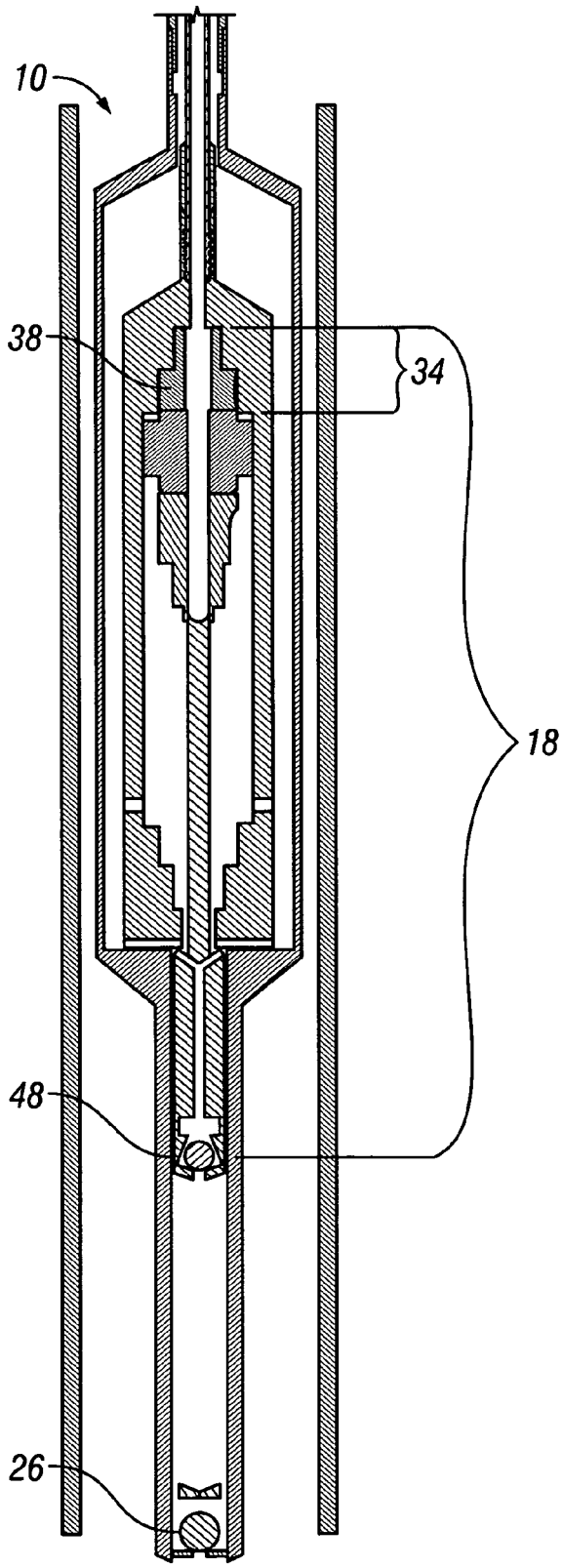
FIG. 4 is a cross-section view of the downhole pump of the fluid balanced pump system with the plunger assembly at the top of the upstroke.

FIG. 4 shows plunger assembly 18 at the upper most part of the upstroke. Some fluid has leaked out of dampening chamber 34 as the surface unit bleeds tubing pressure back down to hydrostatic pressure at pump 10; therefore, dampener 38 is shown closer to the upper stop of chamber 34. The balancing fluid 66 is substantially all in the second conduit 80 and fluid motion has substantially ceased. Both traveling valve 48 and standing valve 26 are closed.

Figure 5:
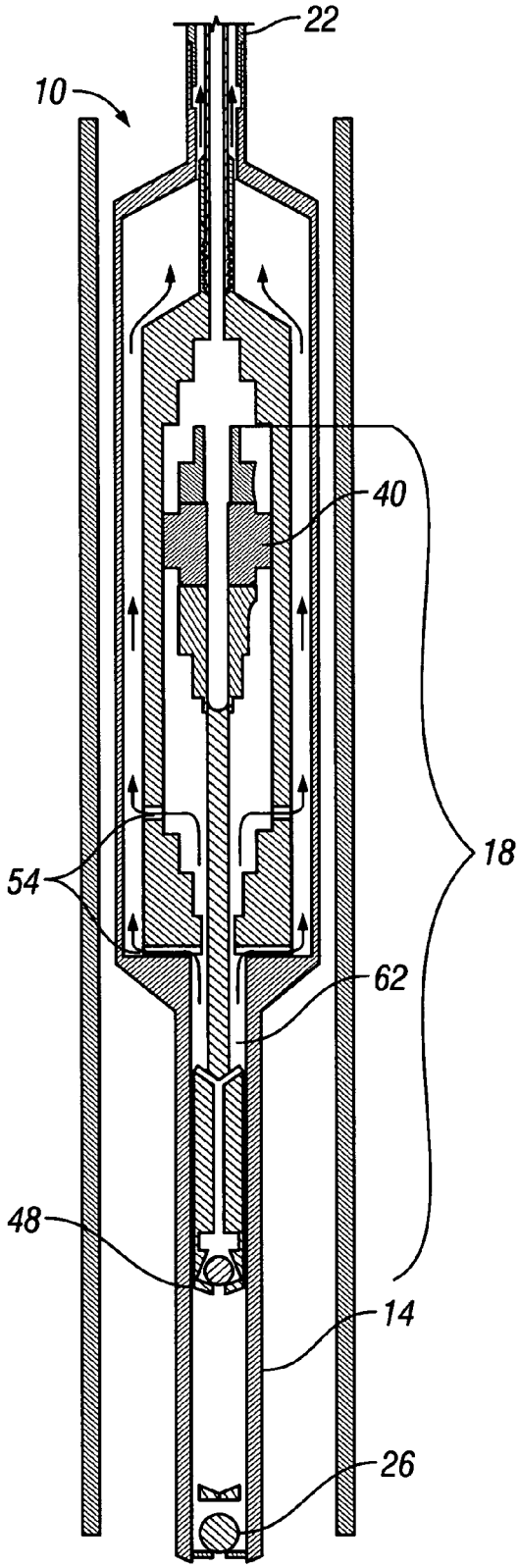
FIG. 5 is a cross-section view of the downhole pump of the fluid balanced pump system with the plunger assembly moving in a downward direction in response to the decrease in pressure from the surface pumping unit and the application of pressure from the balancing fluid contained in the tubing string above the upper plunger.

FIG. 5 shows plunger assembly 18 moving in a downward direction in response to pressure from the balancing fluid 66 against the upper plunger 40. Standing valve 26 is closed and traveling valve 48 opens. Reservoir fluid in lower barrel 14 passes through traveling valve 48 into cavity 62 through ports 54 into annulus 28 and up tubing string 22 to be produced at the surface.

Figure 6:
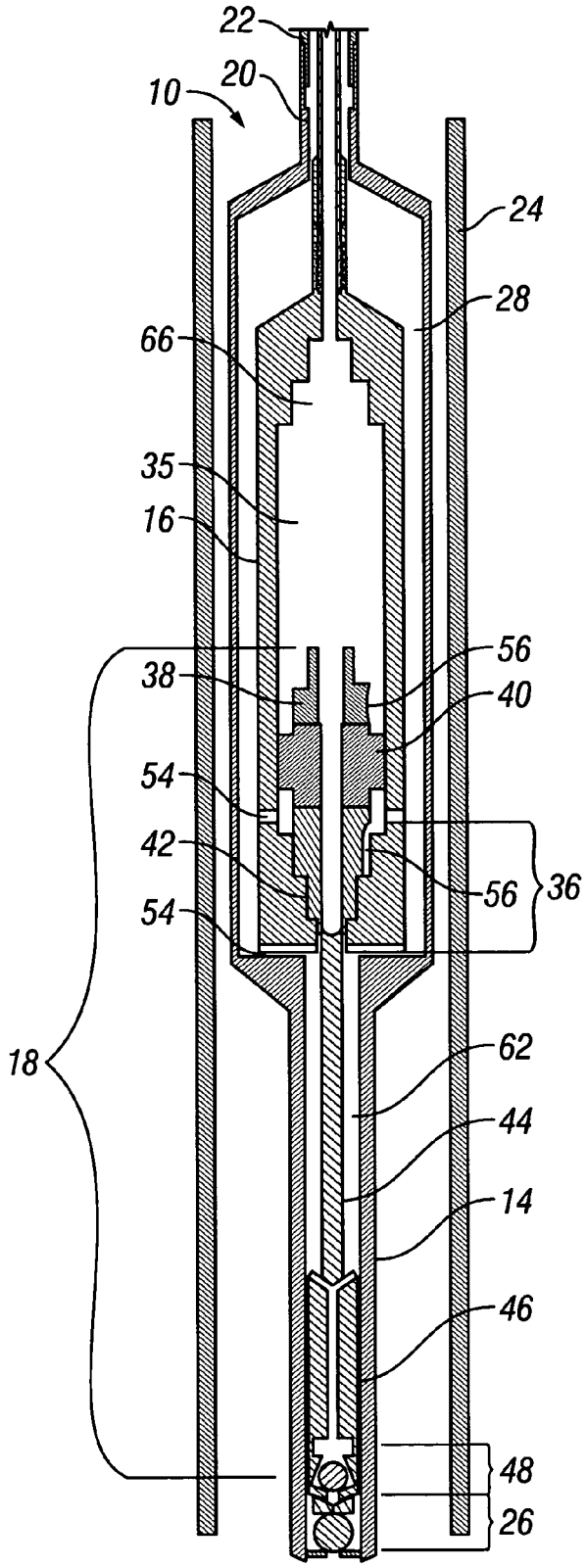
FIG. 6 is a cross-section view of the downhole pump of the fluid balanced pump system with the plunger assembly nearing the bottom of the downstroke.

FIG. 6 shows plunger assembly 18 nearing the bottom of the downstroke. Lower dampener 42 has entered lower dampener chamber 36 and fluid is being metered out of dampener chamber 36 via slot 56. The end of slot 56 has yet to enter chamber 36 thereby trapping the remaining fluid and stopping plunger assembly 18 before metal to metal impact occurs.

Those who are skilled in the art will readily perceive how to modify the present device still further. For example, many connections illustrated are threaded, however, it should be recognized that other methods of connection may be utilized, such as by welding. Additionally, there are many connections, spacers, and additional equipment which may be used within and in connection with the fluid balanced pump. In addition, the subject mater of the present device would not be considered limited to a particular material of construction. Therefore, many materials of construction are contemplated by the present device including but not limited to metals, fiberglass plastics as well as a combination and variation thereof. As many possible embodiments may be made of the present device without departing from the scope thereof, it is to be understood that all matter herein set forth or shown in the accompanying drawings is to be interpreted as illustrative and not in a limiting sense.

What is claimed is:

1. A pump assembly for pumping fluid from a fluid reservoir connected via a first conduit to an operation pressure source, the pump being responsive to the application of pressure on fluid within the first conduit by the operation pressure source, said pump assembly comprising:

a housing connected at the lower end of the first conduit and positioned within a fluid to be transported through said first conduit;

an upper barrel, having a top and bottom end, positioned within said housing;

a lower barrel section extending downwardly from said housing;

a plunger assembly movably disposed so as to move with respect to the upper and lower barrel, said assembly movable in a first direction responsive to pressure applied to fluid in said first conduit for drawing fluid into said housing; and a second conduit, connected to the top end of said upper barrel, filled with a liquid and extending to the surface for moving said plunger assembly in a second direction when pressure is released from said fluid in said first conduit wherein fluid from said reservoir drawn into said housing is produced into said housing.

2. The pump assembly of claim 1, further comprising:

a first dampening mechanism connected to said plunger assembly wherein impact between said plunger moving in said first direction and a portion of said housing is reduced; and a second dampening mechanism connected to said plunger assembly wherein impact between said plunger moving in said second direction and a portion of said housing is reduced.

3. The pump of claim 2, wherein said second dampening mechanism includes a lower dampener connected to said plunger assembly; and a lower dampener chamber formed by said housing shaped so as to fit said lower dampener substantially therein.

4. The pump of claim 2, wherein said first dampening mechanism includes an upper dampener connected to said plunger assembly; and an upper dampener chamber formed by said housing shaped so as to fit said upper dampener substantially therein.

5. The pump claim 4, further comprising:

a slot formed along at least a portion of said upper dampener.

6. The pump assembly of claim 1, wherein said upper barrel and said lower barrel differ in size thus providing a differential area upon which the pressure from the first conduit acts to push said plunger assembly in the first direction causing fluid from the fluid reservoir to be pulled into the lower barrel.

7. The pump assembly of claim 6, wherein the motion of said plunger assembly in the first direction causes the liquid in said second conduit to rise toward the surface thus causing an imbalance in the two conduits such that when pressure is released from said first conduit, the liquid weight in said second conduit pushes said plunger assembly in the second direction, forcing the fluid taken in, on the motion in the first direction, into said first conduit to be delivered to the surface.

8. The pump of claim 3, further comprising:

a slot formed along at least a portion of said lower dampener.

9. The pump of claim 8, further comprising:

a balancing liquid substantially contained in said second conduit and within said housing substantially above said plunger assembly.

10. A pump assembly for pumping fluid from a fluid reservoir connected via a conduit to an operational pressure source, the pump being responsive to the application of pressure on fluid within the conduit by the operation pressure source, said pump assembly comprising:

a housing connected at the lower end of a conduit and positioned within a fluid to be transported through said conduit, said housing comprising a lower barrel section extending from said housing and an upper barrel section located within said housing;

a plunger assembly movably disposed within said upper and lower barrel of said housing, said assembly movable in a first direction responsive to pressure applied to fluid in said conduit for drawing fluid into said housing, said upper barrel, having a top and bottom end, positioned within said housing;

a second conduit, connected to the top end of said upper barrel, filled with a liquid and extending to the surface for moving said plunger assembly in a second direction when pressure is released from said fluid in said first conduit wherein fluid from said reservoir drawn into said housing is produced into said housing;

an upper dampening mechanism connected to said plunger assembly wherein impact between said plunger moving in said first direction and a portion of said housing upper barrel is reduced; and a lower dampening mechanism connected to said plunger assembly wherein impact between said plunger moving in said second direction and a portion of said housing is reduced.

11. The pump of claim 10 wherein said upper dampening mechanism includes an upper dampener connected to said plunger assembly; and an upper dampener chamber, formed by said upper barrel of said housing, shaped so as to fit said upper dampener substantially therein.

12. The pump of claim 11, further comprising:

a slot formed along at least a portion of said upper dampener.

13. The pump of claim 12, wherein said lower dampening mechanism includes a lower dampener connected to said plunger assembly; and a lower dampener chamber, formed by said housing, shaped so as to fit said lower dampener substantially therein.

14. The pump of claim 13, further comprising:

a slot formed along at least a portion of said lower dampener.

15. The pump assembly of claim 14, wherein the slot formed along at least a portion of said lower dampener and along at least a portion of said upper dampener forms a leak path within the dampening mechanism allowing fluid to escape at a controlled rate.

16. The pump of claim 14, further comprising:

a balancing liquid substantially contained in said second conduit and within said housing substantially above said plunger assembly.

17. The pump assembly of claim 16, wherein the motion of said plunger assembly in the first direction causes the liquid in said second conduit to rise toward the surface thus causing an imbalance in the two conduits such that when pressure is released from said first conduit, the liquid weight in said second conduit pushes said plunger assembly in the second direction, forcing the fluid taken in, on the motion in the first direction, into said first conduit to be delivered to the surface.

* * * * *